US010294000B2

(12) United States Patent
Winkler et al.

(10) Patent No.: US 10,294,000 B2
(45) Date of Patent: May 21, 2019

(54) PACKAGING UNIT

(71) Applicant: Robert Bosch GmbH, Stuttgart (DE)

(72) Inventors: Dominic Winkler, Stuttgart (DE); Simone Bosatelli, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/379,079

(22) Filed: Dec. 14, 2016

(65) Prior Publication Data

US 2017/0174407 A1 Jun. 22, 2017

(30) Foreign Application Priority Data

Dec. 18, 2015 (DE) ..... 10 2015 225 930

(51) Int. Cl.
*B65D 73/00* (2006.01)
*B25H 3/00* (2006.01)

(52) U.S. Cl.
CPC ..... *B65D 73/0064* (2013.01); *B25H 3/003* (2013.01)

(58) Field of Classification Search
CPC ..... B25H 3/003; B25H 3/00; B65D 73/0064
USPC ..... 206/349, 806
See application file for complete search history.

(56) References Cited

U.S. PATENT DOCUMENTS 5,975,297 A * 11/1999 Kao ..... B25B 13/56 206/378
6,662,948 B1 * 12/2003 Velliquette ..... B65D 73/0021 206/462
7,175,151 B2 * 2/2007 Chang ..... B65D 73/0014 206/349
7,392,902 B2 * 7/2008 Chang ..... A47F 5/0006 206/349
8,302,772 B2 * 11/2012 Chang ..... B65D 25/22 206/379
8,336,710 B2 * 12/2012 Chang ..... B65D 73/0064 206/349
8,443,972 B1 * 5/2013 Pendergraph ..... B65D 73/0064 206/349
9,387,972 B1 * 7/2016 Wang ..... B65D 79/02
2005/0155945 A1 * 7/2005 Kao ..... B29C 33/005 211/70.6
2006/0201836 A1 9/2006 Pendergraph et al.
(Continued)

FOREIGN PATENT DOCUMENTS

DE 87 15 571 U1 1/1988
DE 298 00 482 U1 4/1998
(Continued)

*Primary Examiner* — Steven A. Reynolds
(74) *Attorney, Agent, or Firm* — Maginot, Moore & Beck LLP

(57) ABSTRACT

A packaging unit, in particular a drilling-tool packaging unit, for an insert tool, in particular a drilling tool, includes a fastening portion for fastening the packaging unit in or on a presentation device, in particular a presentation rack or a sales rack, and a receiving portion for receiving in or on the packaging unit an insert tool that is connected in a form-fitting manner to the receiving portion. The receiving portion is designed to hold the insert tool in a holding state of the packaging unit in which the receiving portion is realized so as to be integral with the fastening portion. In a separation state, in which the receiving portion has been separated from the fastening portion of the packaging unit, the receiving portion remains on the insert tool.

16 Claims, 11 Drawing Sheets

(56) References Cited

U.S. PATENT DOCUMENTS

| | | | | |
|---|---|---|---|---|
| 2007/0034771 | A1 | 2/2007 | Liu | |
| 2007/0138043 | A1* | 6/2007 | Roesler ..... | B25H 3/003 206/379 |
| 2012/0043238 | A1* | 2/2012 | Christopher ..... | B25H 3/003 206/375 |

FOREIGN PATENT DOCUMENTS

| | | | |
|---|---|---|---|
| DE | 698 01 116 | T2 | 3/2002 |
| DE | 10 2005 003 416 | A1 | 10/2005 |
| DE | 10 2012 224 434 | A1 | 7/2014 |
| DE | 10 2012 224 437 | A1 | 7/2014 |
| FR | 2 800 046 | A1 | 4/2001 |

* cited by examiner

PACKAGING UNIT

This application claims priority under 35 U.S.C. § 119 to patent application no. DE 10 2015 225 930.7, filed on Dec. 18, 2015 in Germany, the disclosure of which is incorporated herein by reference in its entirety.

The disclosure relates to a packaging unit, in particular a drilling-tool packaging unit, for an insert tool, in particular a drilling tool, having a first means, in particular a fastening means, for fastening the packaging unit in or on a presentation device, in particular a presentation rack or a sales rack, and having a receiving means for receiving in or on the packaging unit an insert tool that is connected in a form-fitting manner to the receiving means, the receiving means being designed to hold the insert tool in a holding state of the packaging unit in which the receiving means is realized so as to be integral with the first means.

BACKGROUND

A packaging unit, having a hanging region for suspending the packaging unit, and having a holding region for holding a drilling tool, is disclosed in US 2006/0201836 A1. The drilling tool has a delimiting element, in the form of a hollow cylinder, for leading through the drilling tool, and two holding elements that engage in a recess of the drilling tool and secure the drilling tool against accidentally falling out of the packaging unit.

Further, DE 10 2012 224 437 A1 discloses a drilling tool having a taper that extends along a clamping region of the drilling tool in the circumferential direction, and having an enclosing element that encloses the taper of the drilling tool.

SUMMARY

The disclosure is based on the object of improving a packaging unit.

The object is achieved by a packaging unit, in particular a drilling-tool packaging unit, for an insert tool, in particular a drilling tool, having a first means, in particular a fastening means, for fastening the packaging unit in or on a presentation device, in particular a presentation rack or a sales rack, and having a receiving means for receiving in or on the packaging unit an insert tool that is connected in a form-fitting manner to the receiving means. The receiving means is designed to hold the insert tool in a holding state of the packaging unit in which the receiving means is realized so as to be integral with the first means. According to the disclosure, in a separation state, in which the receiving means has been separated from the first means of the packaging unit, the receiving means remains on the insert tool.

The disclosure makes it possible to realize, in a simple manner, a packaging unit that holds the insert tool securely and secures it against working loose, or falling out, in an unwanted manner. In addition, the packaging unit according to the disclosure advantageously enables the insert tool and the receiving means to be detached from the fastening means of the packaging unit. Furthermore, it may be provided that the insert tool and the receiving means can be detached from at least the first means of the packaging unit merely with the aid of a tool such as, for example, a pair of pincers or scissors, in order that, advantageously, shop thefts of such insert tools are rendered more difficult or even avoided.

The receiving means according to the disclosure enables the insert tool to be held on the packaging unit, when the packaging unit is in a holding state, such that the insert tool is fixedly connected to the packaging unit and secured against being detached in an unwanted manner. Further, the receiving means is designed in such a manner that, when the packaging unit is in a separation state, the receiving means continues to remain on the insert tool in a form-fitting manner. In addition, the receiving means may be materially bonded to the insert tool, in particular by means of an adhesive. In this case, separation of the packaging is effected between the receiving means and the first means, in particular the fastening means, of the packaging unit, the receiving means of the packaging unit remaining connected to the insert tool in a form-fitting manner, or in a form-fitting and materially bonded manner.

"Connected in a materially bonded manner" is to be understood to mean, in particular, that the receiving means is held together with the insert tool by atomic or molecular forces, such as, for example, in the case of soldering, welding, adhesive bonding and/or vulcanizing. It is thereby possible, in an advantageously simple manner, to achieve a preferably reliable and structurally simple design of the receiving means.

The receiving means in this case is intended, in particular, to be of a solid design. In particular, the receiving means is not intended to be constituted by a packaging film that is used in conventional packaging units and that, for example when the packaging unit with the insert tool is unpacked, can remain temporarily connected to the insert tool in an unwanted manner. The receiving means is designed to remain on the insert tool when the insert tool is operated with a power tool, in particular a hand-held power tool, such that the receiving means leaves a characteristic impression with the operator of the drilling tool. In particular, the receiving means is made of plastic material.

A "first means" in this context is to be understood to mean, in particular, a part of a packaging that is designed to present the insert tool, in that the part is realized as a mounting means such as, for example, a mounting base, for securely mounting the packaging unit, as an advertising means such as, for example, an advertisement carrier, for advertising the insert tool, and/or as a fastening means such as, for example, a hanger, for hanging the insert tool on a rack.

A "holding state" in this context is to be understood to mean a packed, or unopened, state of a packaging unit, in which the insert tool is held by the receiving means. A "separation state" in this context is to be understood to mean an opened state of a packaging unit, in which, in particular, an insert tool has been substantially separated from a packaging unit.

"In a form-fitting manner" in this context is to be understood to mean a connection of at least two parts, which impede or prevent a relative movement in relation to each other in at least one direction, such that the two parts connected in such a manner can be separated from each other only with the aid of separating tools such as, for example, a saw, in particular a mechanical saw, etc., and/or chemical separating means such as, for example, solvents, etc. In this case, other components or other means such as, for example, adhesive means, are to be avoided in connecting the at least two parts to each other. The at least two parts are realized in this case, in particular, as form-fitting elements that correspond to each other. In this case, a form-fitting element, in particular a surface of a form-fitting element, acts in combination with at least one corresponding form-fitting element, in particular an opposite counter-surface of the corresponding form-fitting element. The two parts in this case are to be understood to be a connection of at least two components that can be separated from each other only with the aid of separating tools such as, for example, a saw, in particular a mechanical saw, etc., and/or chemical separating means such as, for example, solvents, etc. One of these two parts in this case may be realized, in particular, as a receiving means, and the other part as an insert tool.

"Directly connected" in this context is to be understood to mean, in particular, fitting against and/or connected at least in a form-fitting manner, with use of other components being avoided.

"Integrally" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank.

"Presentation device" in this context is to be understood to mean a device designed to present an insert tool, in which the insert tool is mounted, for example, in a lying, upright or hanging position. The presentation device in this case may be realized as a sales rack, for example of a carrier device, for suspending the packaging units.

The dependent claims specify expedient developments of the packaging unit according to the disclosure.

It may be expedient for the packaging unit to have a holding means, in particular realized as a holding element, for holding the receiving means in a holding state, in particular in or on the packaging unit. Preferably, a plurality of holding means may be provided for holding the receiving means.

A "holding means" in this context is to be understood to mean a means for holding a receiving means of the packaging unit and/or of an insert tool. The holding means in this case may be realized so as to be integral with the receiving means.

In particular, the packaging unit may have a receiving region, in particular designed to receive an insert tool, that contains the receiving means and/or the holding means of the packaging unit.

A "receiving region" in this context is to be understood to mean a region of a packaging unit that is designed to receive an insert tool and to hold it in or on the packaging unit. In particular, the insert tool is held in or on the packaging unit by means of the holding means and/or the receiving means.

Preferably, the packaging unit may have a fastening region, adjacent to or adjoining the receiving region, preferably for fastening the packaging unit in or on a presentation device. The fastening region may have the first means, in particular, the fastening means.

Further, it may be expedient for a connecting means, in particular having a material weakness, to be realized between the holding means, in particular realized as a holding element, and the receiving means. The receiving means can thereby advantageously be separated from the holding means, such that the receiving means remaining on the insert tool provides an operator with a high recognition factor, and advantageously identifies the insert tool. Further, the receiving means may be designed to damp vibrations in the insert tool when the insert tool is in operation.

A connecting means of the packaging unit, in particular realized as a material weakness, serves in this case as a predetermined breaking point that advantageously separates the receiving means from the holding means, in particular of the receiving region. In particular, when separating the receiving means from the holding means, a user receives a direct feedback, for example as a clicking or cracking sound, whereby it is unambiguously clear to the user that the insert tool has now been released from the holding element of the packaging unit, and the insert tool, with the receiving means remaining on the insert tool, can be used.

A "connecting means" in this context is to be understood to mean a structural element provided by structural or mechanical, or physical, measures or designs that, in particular, fails in a selective, or predictable, manner if a designed load is exceeded. In particular, the connecting means may be realized as a material weakness. The material weakness may be realized as a perforation. The perforation in this case may comprise a single material opening or a multiplicity of material openings. The material weakness may be realized as a predetermined breaking point. The material weakness may be realized as a notch, a cavity, a taper, such as, for example, a recess, or a weakness, in particular a selective weakness, in the material or in the material structure of the packaging unit. The connecting means may extend around the insert tool, in particular partially or entirely, in the circumferential direction, preferably in a plane around 360°, in order to hold, or connect, the holding means to the receiving means in a fixed and reliable manner.

In particular, the connecting means is realized so as to be integral with the holding means and the receiving means. It is thereby ensured that, in a holding state, the holding means holds the receiving means securely and, in a separation state, is reliably separated from the receiving means, for example as a result of a tensile motion and/or a torsional motion and/or an alternative relative motion.

It may furthermore be expedient for the receiving means to be realized as an enclosing element and to be designed to encompass the insert tool in a form-fitting manner. The enclosing element in this case may constitute an enclosure around a portion of the insert tool. An "enclosure" is to be understood to mean, in particular, a covering of the insert tool, which is made of at least one further material and which, in particular, can have a protective function.

It may further be expedient for the receiving means to be realized, at least substantially, in the form of a hollow cylinder. In particular, the receiving means may encompass the insert tool in a plane around 360°. As a result, the receiving means, with the insert tool, can realize a fixed and robust connection between the receiving means and the insert tool. "At least substantially in the form of a hollow cylinder" in this context is to be understood to mean a basic hollow-cylinder shape, preferably having a deviation from this basic shape that is considered usual by persons skilled in the art.

It may be expedient for the receiving means to be designed to cover, at least partially, a recess of the insert tool that is realized, in particular, as a taper. In particular, the taper may encompass the insert tool in the circumferential direction in a plane around 360°. Preferably, the taper is provided in or on an intermediate region of the insert tool.

An "intermediate region" in this context is to be understood to mean a region of the insert tool that is disposed between the insertion region and the working region. The intermediate region may be designed, in particular, to bridge a desired distance between the insertion region and the working region, such that a desired tool length is achieved. The intermediate region may have, in particular, an outer contour that differs from the insertion region and/or working region. The intermediate region is preferably realized so as to be at least substantially rotationally symmetrical. In particular, the intermediate region may be designed to transmit forces and moments between the insertion region and the working region. "At least substantially rotationally symmetrical" in this context is to be understood to mean a radius deviation, about the tool axis, of less than 10%, preferably less than 5%, particularly preferably less than 1%. Preferably, the intermediate region is realized so as to be integral with the insertion region and/or at least portions of the working region.

A "taper" in this context is to be understood to mean, in particular, a sub-region of the intermediate region that has a reduced diameter, as compared with a greatest diameter of the intermediate region. In particular, the taper reduces a material cross section of the intermediate region. A "material cross section" in this context is to be understood to mean, in particular, a cross section of the material of the intermediate region that is designed to transmit more than 50%, preferably more than 80%, particularly preferably more than 90%, of the forces and moments between the insertion region and the working region. Preferably, the material cross section is constituted by a metallic material. A "diameter" of the intermediate region in this context is to be understood to mean, in particular, a diameter measured perpendicularly in relation to the longitudinal axis of the tool. A "sub-region" in this context is to be understood to mean a portion of the intermediate region that has a reduced diameter, as compared with a greatest intermediate-region diameter.

As a result, the receiving means can be connected to the insert tool in a reliable manner. Also, as a result, increased stresses in the insert tool which are produced because of the recess and a therewith associated reduced supporting cross section of the insert tool, can be compensated, at least partially, by the receiving means. In particular, the receiving means can serve as a damping element, and be designed to damp vibrations in the insert tool that are produced when the insert tool is in operation. "Damping" in this context is to be understood to mean, in particular, a reduction of the extreme values by a spring action of the sub-region of the insert tool having a reduced diameter.

Further, it may be expedient for the receiving means to be injection-molded onto the insert tool. A firm and stable connection is thereby ensured between the receiving means and the insert tool.

In particular, the receiving means may delimit a maximum extent of the packaging unit in a direction away from the first means. This enables a greatest possible moment to be applied to the connecting means in the case of release, or separation, of the receiving means from the at least one holding means, in order to ensure simple and reliable detaching of the insert tool, or receiving means, from the holding means.

Further, it may be expedient for the receiving means to have a maximum outer diameter, and an insertion region and/or a working region of the insert tool to have a maximum outer diameter, the maximum outer diameter of the receiving means being less than or equal to the maximum outer diameter of the insertion region and/or working region of the insert tool. This enables the insert tool, in particular an insertion region of the insert tool, to be inserted particularly easily in, for example, a receiving device of a hand-held power tool, without reducing or preventing a clamping action of the receiving device upon the insertion region of the insert tool by the receiving means set back radially relative to the insertion region of the insert tool.

Further, it may be expedient for the receiving means to have a maximum outer diameter, and an insertion region and/or a working region of the insert tool to have a maximum outer diameter, the maximum outer diameter of the receiving means being greater than the maximum outer diameter of the insertion region and/or working region of the insert tool. When an insert tool is being clamped in a receiving device of a power tool, the receiving means can thereby serve as a stop element that defines, or delimits, a clamping depth of the insert tool in the receiving device.

Furthermore, it may be expedient for the packaging unit, in particular the receiving means of the packaging unit, to have at least one information element realized as a number, a letter, a color and/or a symbol. In particular, the information element may be realized as a protuberance and/or a depression. As a result, advantageously, even after repeated use of the insert tool, a user can obtain information from the receiving means, which information is usually imprinted, for example, on conventional insertion regions of, for example, drilling tools, and which become poorly legible with increasing wear or use of the drilling tool.

Further, it may be expedient for the holding means to be realized as a holding arm or a holding ring. In the case of a holding means realized as a holding arm, the insert tool and the receiving means can be separated particularly easily from the holding means, in that the insert tool and the receiving means are moved relative to the holding means and/or the fastening region. The operator in this case can choose freely between a rotatory and/or a translational and/or another relative motion. In the case of a holding means realized as a holding ring, the holding ring can be made so as to be more stable than a holding means realized as a holding arm, such that the holding ring can also support and reliably hold a proportionally greater weight of the insert tool. The packaging can thereby be simplified.

Furthermore, it may be expedient for at least the holding means to have a separation device for releasing or separating the insert tool and/or the receiving means from the holding means. In this case, particularly heavy insert tools, or also popular insert tools that, for example, are wrongfully taken with noticeable frequency, can also additionally be secured against theft. Consequently, a potential thief has to make a comparatively large amount of effort to separate the insert tool from the packaging unit, or from the first means, which could thus desist from theft of the insert tool. In particular, the separation device may be provided on the holding means and/or on the receiving means. The separation means may be realized as a connecting means, in particular realized as a material weakness and/or as a material. The separation device may have a separation recess and/or a separation cavity. The separation device is designed to weaken the packaging unit, in a first step, at a position designed for this purpose, in particular by means of an auxiliary tool such as, for example, a pair of pliers or a screwdriver, and to at least partially release the insert tool and, in a subsequent step, to very easily separate the insert tool, with the receiving means, from the holding means of the receiving region.

It may be expedient for the first means, in particular the fastening means, to have in the packaging unit a material opening, and to be designed to suspend or fasten the packaging unit in or on a presentation device, in particular a presentation rack or a sales rack. In particular, the first means may be substantially triangular, such that the packaging unit, or the fastening region, can be suspended on carrier rails, including a single rail and/or a double rail, or Euro-standard hole hook. The first means can thereby be suspended in a secure and reliable manner in or on a sales device.

Preferably, the substantially triangular first means is oriented in the packaging unit in such a manner that a single suspension corner of the first means is oriented opposite the two other corners, going from the receiving region in the direction toward the fastening region. In particular, the suspension corner delimits the first means in a direction going from the receiving region to the fastening region. Preferably, the suspension corner of the first means is disposed at a distance from the two other corners of the first means, in a direction going from the receiving region to the fastening region.

A "material opening" in this context is to be understood to mean, in particular, a reduction in the thickness of the material, preferably of the first means, of the packaging unit, by, in particular, 100%, and/or an, in particular, complete severing of the material thickness, preferably of the first means, of the packaging unit.

This has the advantage, in particular, that the first means suspends the packaging unit in a more stable manner in comparison with, for example, a Euro-standard hole, such that the carrier rails holding the packaging unit in a suspended manner can also be changed without difficulty from a double rail to a single rail, without, in the case of inadvertently incorrect suspension, the single rail becoming caught in a region of the substantially triangular first means intended for the double rail, and thereby assuming an incorrect orientation angle of the packaging unit in a hanging state. Owing to the substantially triangular first means, it is ensured that, in the case of inadvertently incorrect suspension on a carrier rail realized as a single rail, the packaging unit aligns itself automatically as a result of the weight force acting on the packaging unit and the insert tool, in that the single rail slides into the suspension corner, or a middle region, of the first means.

The disclosure additionally relates to a system comprising a packaging unit and an insert tool intended to be received by means of the packaging unit.

BRIEF DESCRIPTION OF THE DRAWINGS

Further advantages are disclosed by the following description of the drawing. The drawing shows exemplary embodiments of the disclosure. The drawing, the description and the claims contain numerous features in combination. Persons skilled in the art may also expediently consider the features individually and combine them to create appropriate further combinations.

These are shown in.

DETAILED DESCRIPTION

In the figures, components that are the same are denoted by the same references.

The following figures each relate to a packaging unit, in a substantially usual commercial form, with an insert tool realized, in particular, as a drilling tool, chisel, bit or saw blade, having a rotatory working motion and a translatory advance onto a workpiece on which work is to be performed. The packaging unit is designed, in particular, to accommodate, and reliably hold in or on the packaging unit, at least one insert tool realized as a masonry drilling tool.

Figure 1:
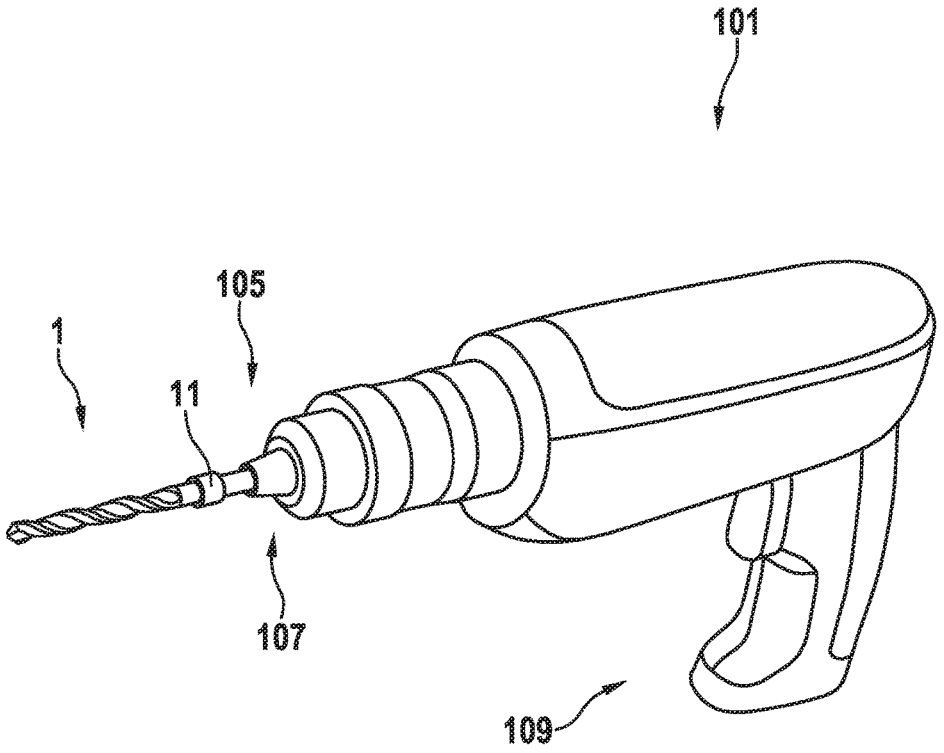
FIG. 1 a perspective view of a hand-held power tool with an insert tool.

FIG. 1 shows a perspective view of a hand-held power tool 101, with an insert tool 1 received, or clamped, in a receiving device 105. The hand-held power tool 101 in this case has a hand-held tool housing 103, having at least one grip region 109 to be gripped by at least one hand of a user. The receiving device 105 has a clamping device 107 that has, for example, a plurality of clamping jaws. The clamping device 107 is designed to hold, in particular to chuck, or clamp, the insert tool 1 radially in the receiving device 105.

Figure 2:
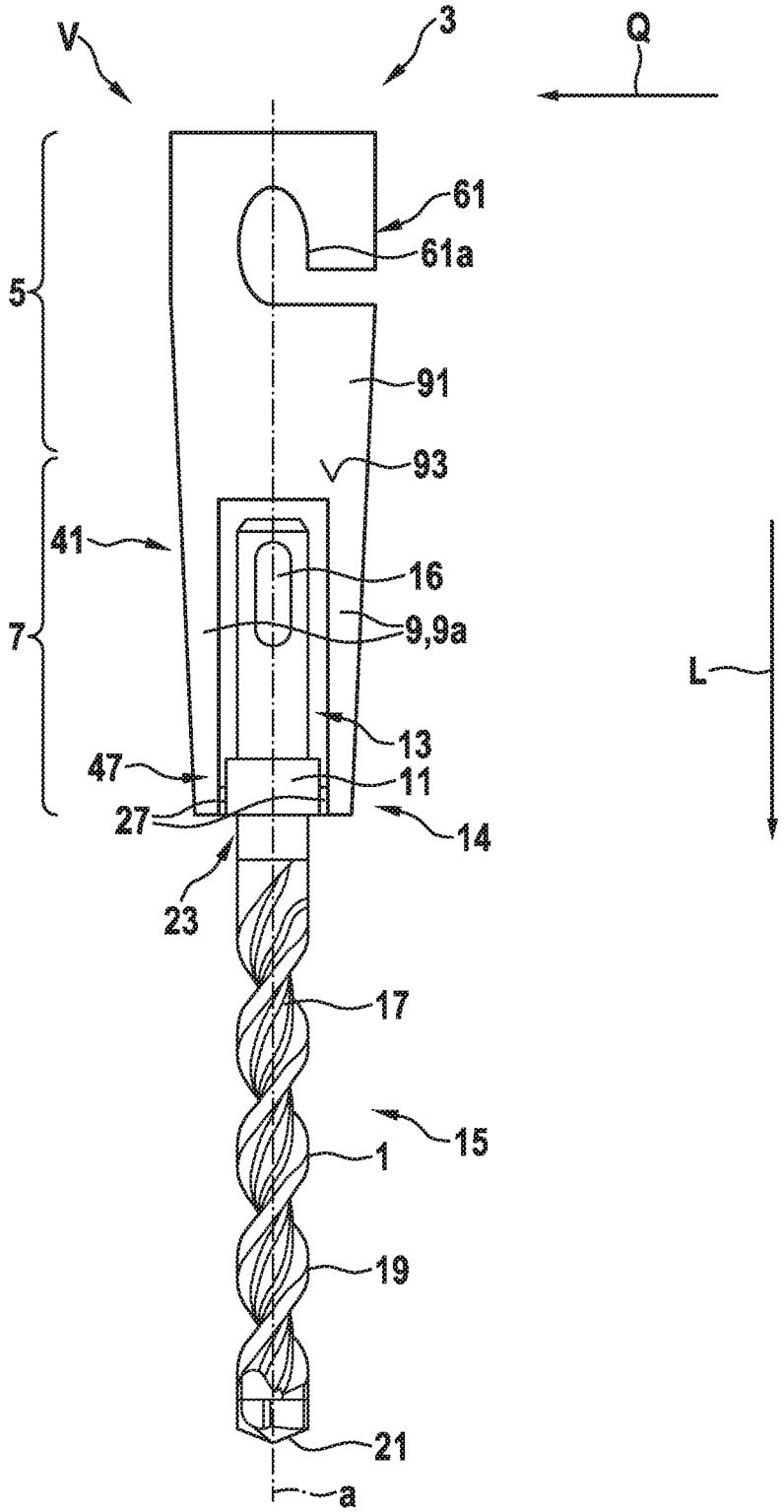
FIG. 2 a view of a first embodiment of a packaging unit according to the disclosure, FIG. 3 a view of a first embodiment of the insert tool, FIG. 4 a view of a second embodiment of the insert tool, FIG. 5 a further view of the first embodiment of the packaging unit, in a separated state, FIG. 6 a view of a second embodiment of the packaging unit according to the disclosure, FIG. 7 a further view of the second embodiment of the packaging unit, FIG. 8 a further view of the second embodiment of the packaging unit, FIG. 9 a view of a third embodiment of the packaging unit according to the disclosure, FIG. 10 a further view of the third embodiment of the packaging unit, and FIG. 11*a*-11*d* a plurality of exemplary views of a first means.

FIG. 2 shows a first embodiment of a packaging unit 3 according to the disclosure, having a fastening region 5 and a receiving region 7 that adjoins the fastening region 5 in the longitudinal direction L. The packaging unit 3 is realized to keep, or accommodate insert tools 1 such as, for example, drilling tools or bits, or screwdriver bits. The packaging unit 3 in this case is designed to accommodate precisely one insert tool 1. In an alternative embodiment, the packaging unit 3 may also be designed to accommodate a plurality of insert tools 1. The packaging unit 3 enables an insert tool 1 to be easily held and kept in the packaging unit 3, such that as large a region as possible of the insert tool 1 is exhibited and accessible to a user or interested party.

The packaging unit 3 is realized, at least substantially, in the shape of a rectangle, having a main extent in the longitudinal direction L. In this exemplary embodiment, the packaging unit 3 is of a substantially flat design, such that the packaging unit 3 is of a substantially flat, thin design, having a main extent in the longitudinal direction L and having a plane in the transverse direction Q, the transverse extent oriented at right angles to the main extent. The flat design of the packaging unit 3 has a front side V and, facing away from the front side V, a back side R of the packaging unit 3.

A "longitudinal direction" is to be understood to mean a direction along a main extent of the packaging unit 3 and/or, in particular, along a rotation axis a of an insert tool 1 held or accommodated in the packaging unit 3.

A "transverse direction" in this context is to be understood to mean a direction that is angled, in particular, at an angle in a range of from approximately 85° to 95°, in particular in a range of from 88° to 92°, to the longitudinal direction. In particular, the transverse direction may be understood to mean a direction that is perpendicular, or at right angles, to the longitudinal direction of the packaging unit 3.

The packaging unit 3 additionally has a longitudinal axis a that is disposed parallel to the longitudinal direction L and that, in particular, constitutes an axis of symmetry a, preferably of the receiving region 7, of the packaging unit 3, such that the axis of symmetry a divides the packaging unit 3 into two symmetrical packaging parts, along the longitudinal axis L. A symmetrical orientation of the packaging unit 3, with an insert tool 1 accommodated in or on the packaging unit 3, is thereby achieved, provided that the insert tool 1 is accommodated coaxially with the longitudinal axis a in or on the packaging unit 1.

Expediently, the fastening region 5 of the packaging unit 3 has a first means 61, realized as a material opening 61*a* through the packaging unit 3, which serves to fasten the packaging unit 3 in or on a presentation device, not represented in greater detail, in particular a presentation rack or a sales rack. The first means 61 is realized as a fastening means 61. The fastening means 61 is designed in such a manner that a carrier rail 121, for example of a presentation device, is passed through the fastening means 61, in order to suspend the packaging unit 3, or the fastening region 5, on the carrier rail 121 in a form-fitting and/or force-fitting manner. The fastening means 61 may have an open shape, such as, for example, in the case of the hook-shaped fastening means 61 according to FIG. 2, or a closed shape, such as, for example, in the case of the triangular fastening means 61 according to FIG. 4.

If the fastening means 61 is of an open shape, it is not absolutely necessary to pass the carrier rail 121 through the fastening means 61, such that the carrier rail 121 can also be inserted laterally onto the fastening means 61. The open shape of the fastening means 61 has a circular or elliptical material opening 61, which extends in the longitudinal direction L, or along the longitudinal axis a and along the transverse direction Q of the packaging unit 3. The open shape of the fastening means 61 additionally has a further material opening 61, which adjoins a lower portion of the circular or elliptical material opening 61, and which is disposed at a distance from the longitudinal axis a of the packaging unit 3. The further material opening 61 extends in the transverse direction Q toward a side of the packaging unit 3, and enables an open, or hook-type, fastening means 61 to be provided. The fastening region 5 is thus designed in the shape of a hook, such that the packaging unit 3 can also be passed through the material opening 61 that is open toward the side, transversely in relation to the longitudinal direction L, in order to suspend the packaging unit 3.

On the front side V of the packaging unit 3, the fastening region 5 additionally has an identification region 91, which may be designed, for example, to be inscribed or provided with inscription elements in the form of stickers or labels having, for example, information means and/or advertising means. The identification region 91 has an identification surface 93. The identification surface 93 is of a flat design.

The receiving region 7 has two holding means 9, and a receiving means 11 that is realized as an enclosing element 11. The receiving region 7 is designed to receive an insert tool 1. The holding means 9 are of an elongate design, and extend substantially in the longitudinal direction L. The holding means 9 are realized as holding arms 9*a*, and connect, in particular, the receiving means 11 to the fastening region 5 of the packaging unit 3.

In FIG. 2 to FIG. 5, the insert tool 1 is realized as a drilling tool. The drilling tool is a standard commercial drilling tool, having an insertion region 13 and a working region 15 that adjoins the insertion region 13. The insert tool 1 has an insertion region 13 and a working region 15 having a diameter D4, and having a tip that has a cutting element 21. The working region 15 additionally has at least one flute 17 for removing drilling debris that is produced, and two webs 19 delimiting the at least one flute 17. However, all possible embodiments of a working region 15 of the drilling tool 1 are conceivable here. The insertion region 13 and the working region 15 are connected by an intermediate region 14. The drilling tool 1 has a total length that is divided into a working-region length, a length of the intermediate region 14, and an insertion length. The drilling tool 1 is designed to produce rotationally symmetrical drilled holes in a workpiece. The insertion region 13 serves to mount the drilling tool 1 in a tool receiver of the hand-held power tool, and conforms to an appropriate industry standard. The insertion region 13 may have at least one holding recess 16 for connecting the drilling tool to the receiving device 105 of the hand-held power tool or of the hand-held tool in a form-fitting manner. Also conceivable, in principle, are other insertion regions 13, considered appropriate by persons skilled in the art, such as, for example, insertion regions 13 comprising a plurality of holding recesses 16 and/or slots (not shown) that are at least partially analogous to, in particular similar to, and preferably conformant with, an insertion region 13 in accordance with an SDS drilling tool.

In a sub-region 24, the intermediate region 14 has a recess 23 realized as a taper. A length of the sub-region 14*a* is greater than one third of the insertion length, and less than a sum of the insertion length half of the working-region length. The sub-region 14*a* is delimited by radii R. Starting from a greatest diameter D2 of the intermediate region 14, in the region of the taper 23*a* the sub-region 14*a*, having a diameter D3, tapers to a least diameter D4. In the direction of the working region 15, the diameter D3 of the intermediate region 14*a* increases again, starting from the least diameter 40*a*, until it again attains the greatest diameter D2. The change in the diameter D3 is effected continuously, in a shape approximating a parabola. The sub-region 14*a* having a reduced diameter D3 extends over approximately the entire length of the intermediate region 14. The least diameter D4 in this case is reduced by 60% relative to the greatest diameter D2 of the intermediate region 14.

The reduction in the diameter D3 of the taper 23*a* of the intermediate region 14 to the least diameter D4 has the effect of damping and limiting torque peaks that, inter alia, may occur during operation of the insert tool 1 if the cutting elements 21 of the insert tool 1 become caught in a workpiece on which work is to be performed.

Figure 3:
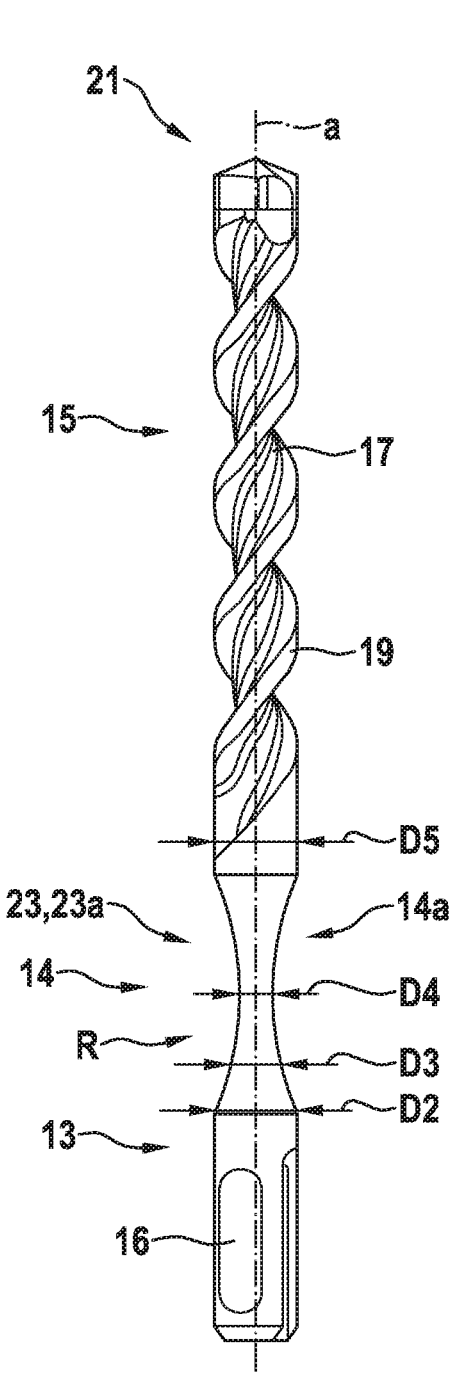
Figure 4:
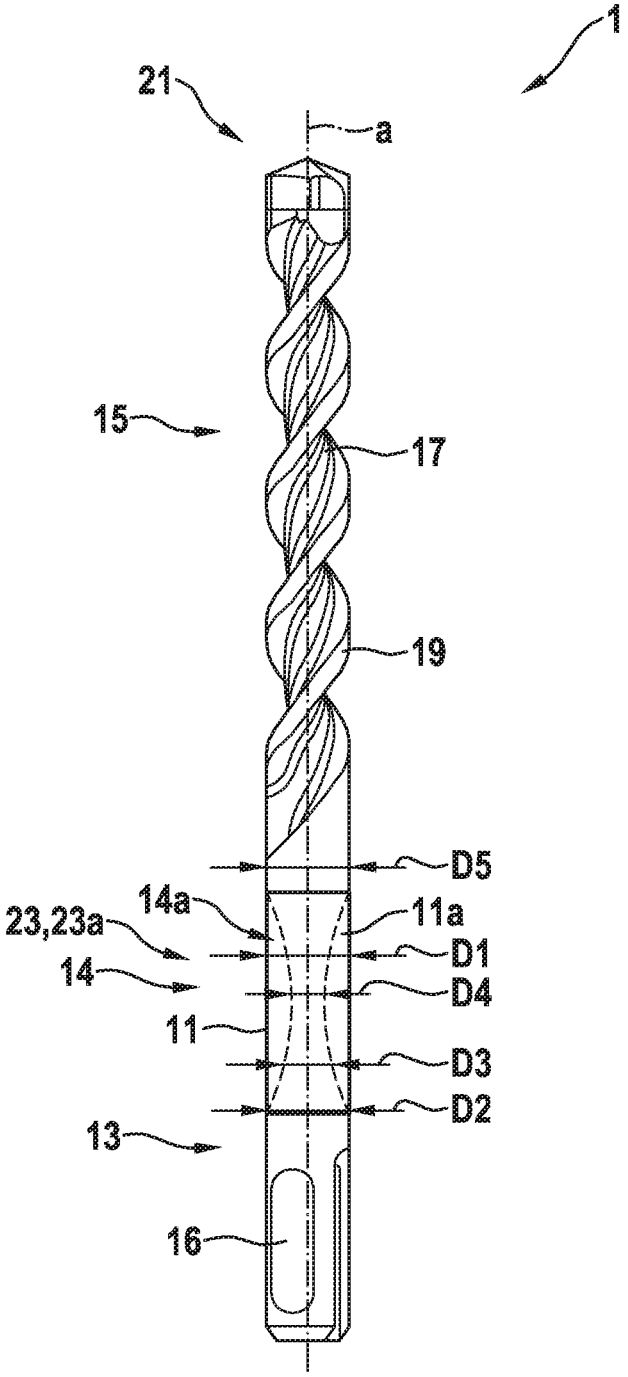
Figure 5:
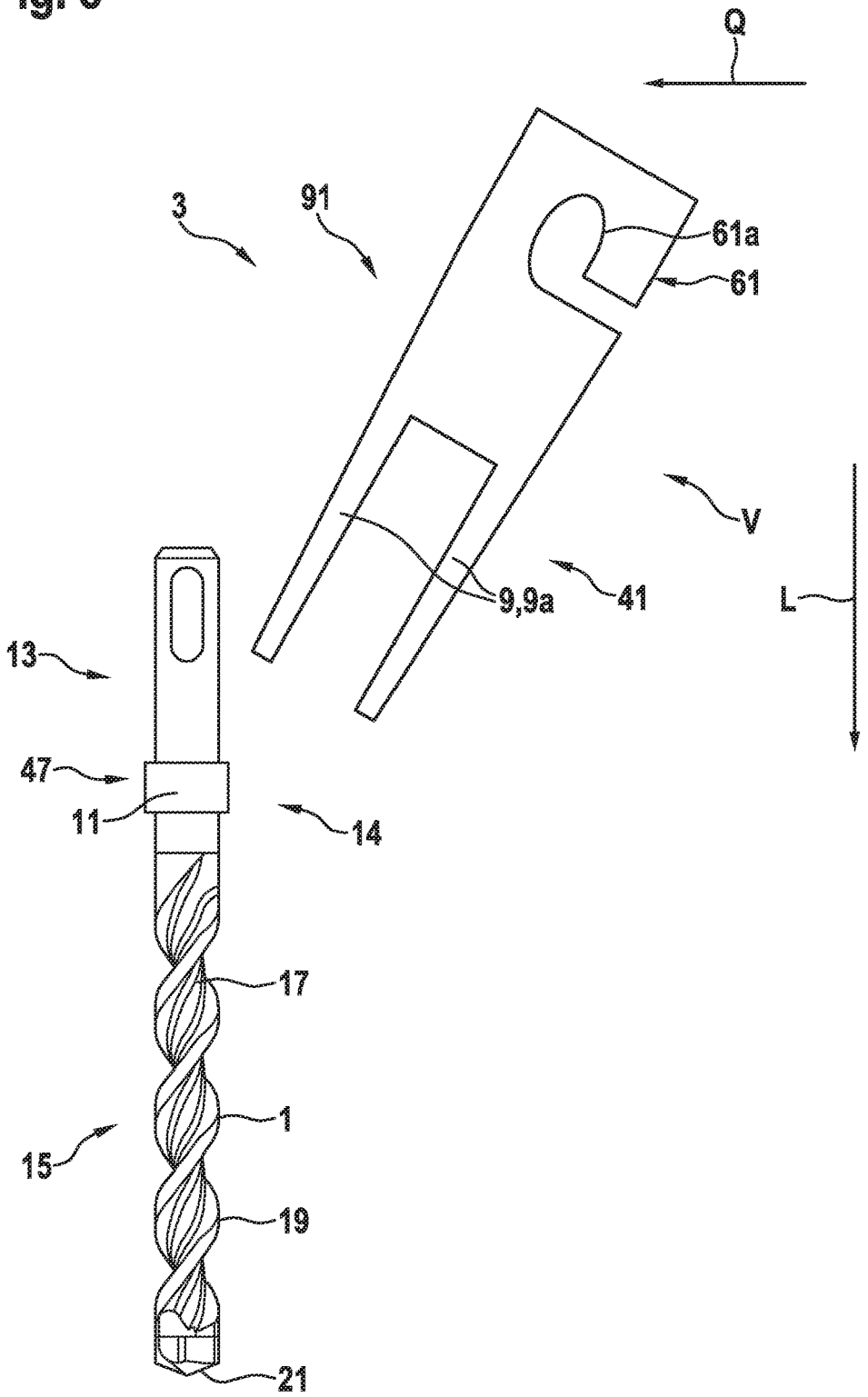

FIG. 4 shows the insert tool from FIG. 3, and a receiving means 11 that is realized as a enclosing element. The receiving means 11 forms an enclosure 11*a*, which extends from an insertion region 13 to a working region 15, along an intermediate region 14. The receiving means 11 is made of a plastic material, and injection-molded onto the drilling tool 1 in an injection-molding process. An outer diameter D1 of the receiving means 11 corresponds to a diameter D2 of the insertion region 13. The outer diameter D1 is advantageously 1-5% smaller than a diameter D5 of the working region 15, such that the receiving means 11 can be inserted in a drilled hole in a workpiece produced by the insert tool 1. The receiving means 11 covers a taper 23*a* of a sub-region 14*a* of the intermediate region 14.

The recess 23 is realized as a taper 23*a* in the diameter, such as, for example, according to the patent application DE 10 2012 224 437 A1 or DE 10 2012 224 434 A1 of the insert tool.

The receiving means 11 is disposed, along the longitudinal direction L, on a direction of the receiving region 7 of the packaging unit 3 that faces away from the fastening region 5 of the packaging unit 3, and delimits a maximum extent of the packaging unit 3 in the longitudinal direction L. The receiving means 11 is realized in the form of a circular ring, and entirely encompasses the recess 23 of the insert tool 1 on a plane around 360°. The receiving means 11 is integrally connected to the holding means 9. The two holding means 9 in this case delimit the receiving means 11 in the transverse direction Q. The receiving means 11 delimits a maximum extent of the packaging unit 3 in the longitudinal direction L, to enable the receiving means 11 to be detached as easily as possible from the holding means 9. The receiving means 11 is designed to hold the insert tool 1 on the packaging unit 3.

Between the receiving means 11 and the two holding means 9, the receiving region 7 has a respective connecting means 27, which connects the receiving means to the holding means 9 in a materially bonded manner. Alternatively, the connecting means 27 may be provided between the receiving means 11 and just one of the two holding means 9. The connecting means 27 has a material weakness 27. The connecting means 27 is realized as a predetermined breaking point, and is deliberately designed to fail at this predetermined breaking point if an unacceptably high stress is attained. The connecting means 27 may be realized as a notch, or cavity, or as a perforation. The user of the packaging unit 3 can then, for example, grip the fastening region 5 of the packaging unit 3 with one hand, and with the other hand can stress, or twist, the working region 15 of the insert tool 1 about the fastening region 5, relative to the working region 15, and thereby generate a maximum force on the connecting means 27. The insert tool 1, with the receiving means 11, can thereby be separated particularly easily from the holding means 9, as can be seen, for example, in FIG. 5. The receiving means 11 in this case, after having been separated, or released, from the holding means 9, remains on the insert tool 1.

The receiving region 7 additionally has a viewing region 41. The viewing region 41 is delimited by the holding means 9 and the receiving means 11. The viewing region 41 allows both visual and haptic access to the insertion region 13 of the drilling tool, to enable the user to appraise and preselect, for example, the insertion region 13 of the drilling tool.

The receiving means 11 additionally has an information element 47, which may provide a user with information such as, for example, a company name, an intended purpose or further information that is useful to an operator. For example, the information element 47 may be realized as a color that, on the basis of a color table, is assigned, for example, to information provided by the identification region 91, in order to make it easier for the operator to select the suitable insert tool 1. Moreover, the information element 47 can provide the operator with an advantageous recognition factor for the insert tool 1.

Figure 6:
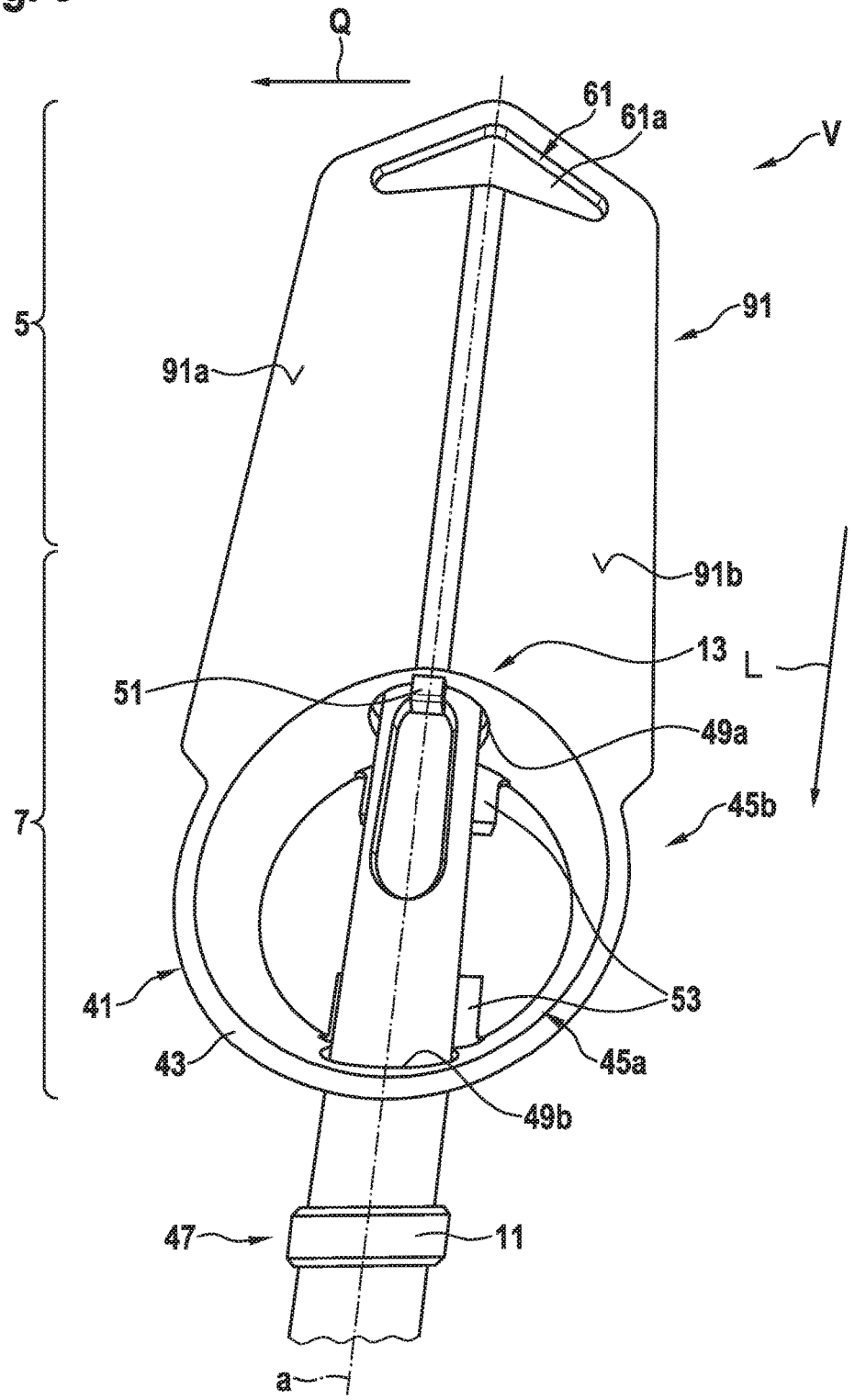

FIG. 6 shows a second embodiment of the packaging unit 3 according to FIG. 2. The packaging unit 3 likewise has a viewing region 41, which in this embodiment, however, is realized substantially in the form of a circle. The viewing region 41 in this case is delimited by a substantially hollow cylinder wall 43.

The wall 43 has an inner region 45*a* and, surrounding the inner region 45*a*, an outer region 45*b*. The inner region 45*a* has an inner surface 43*a*. The outer region 45*b* has an outer surface 43*b* that faces away from the inner surface 43*a*. The inner region 45*a* delimits the viewing region 41 of the packaging unit 3.

The wall 43 additionally has a first recess 49*a* and, opposite the first recess 49*a*, a second recess 49*b*, which is designed to lead through the insert tool 1 and receive, or hold, it in the packaging unit 3. The first recess 49*a* and the second recess 49*b* are disposed concentrically in relation to each other, thereby enabling the insert tool 1 to be securely and reliably fixed in the packaging unit 3. The two recesses 49*a*, 49*b* are disposed along the longitudinal axis a of the packaging unit 3 that extends in the longitudinal direction L of the packaging unit 3. The first recess 49*a* is provided in a region that adjoins the fastening region 5. The second recess 49*b* is disposed on a freely projecting region of the receiving region 7 of the packaging unit 3 that faces away from the fastening region 5.

Adjoining the first recess 49*a*, the inner surface 43*a* of the inner region 45*a* has a fixing means 51 for fixing the insert tool 1 in or on the packaging unit 3. The fixing means 51 is realized in the form of a hook. The fixing means 51 extends in the longitudinal direction L, protruding with respect to the inner surface 43*a* of the inner region 45*a*. The fixing means 51 in this case projects into the viewing region 41. The fixing means 51 additionally extends at right angles in relation to the longitudinal direction L and the transverse direction Q, such that the fixing means 51 projects, for example, into a holding recess 16 of the insert tool 1 accommodated in the packaging unit 3, and thus in a form-fitting manner protects the insert tool 1 against falling out, or slipping out. The fixing means 51 may additionally be designed to hold the insert tool 1 in the packaging unit 3, so as to relieve the connecting means 27 and thus enable the connecting means 27 to be realized, in particular, so as to be less robust than a connecting means 27 of a packaging unit 3 that has no fixing means 51.

In FIG. 6, the closed fastening means 61 is realized so as to be substantially triangular. The fastening means 61 has three rounded corners and three rectilinear edges that connect the rounded corners. Alternatively or additionally, the fastening means 61 may have at least partially rounded, or even pointed, corners. Alternatively or additionally, the corners may be polygonal. Alternatively, at least one of the edges may be at least partially curved. The fastening means 61 is oriented in the packaging unit 3 in such a manner that a corner realized as a suspension corner 97 is spaced apart, in the longitudinal direction L, from the two other corners of the fastening means 61, and delimits the fastening means 61 in a direction going from the receiving region 7 to the fastening region 5.

The identification region 91 has a first identification surface 93*a* and a second identification surface 93*b*. The two identification surfaces 93*a*, 93*b* are flat. In an alternative embodiment, the identification surfaces 93*a*, 93*b* may be of a curved design. The identification surfaces 93*a*, 93*b* are angled in relation to each other, and adjoin each other along the longitudinal direction L of the packaging unit 3.

Figure 7:
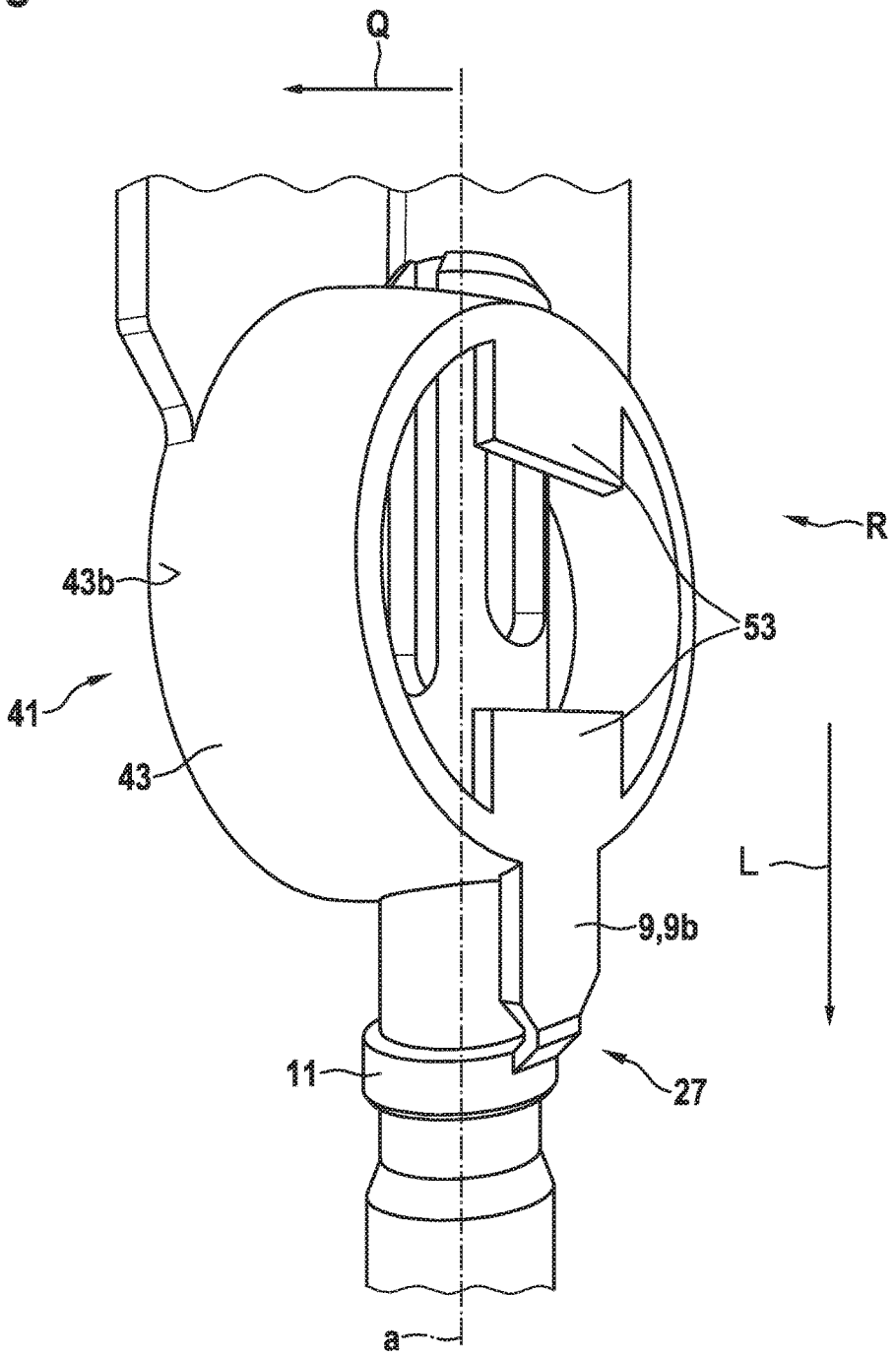
Figure 8:
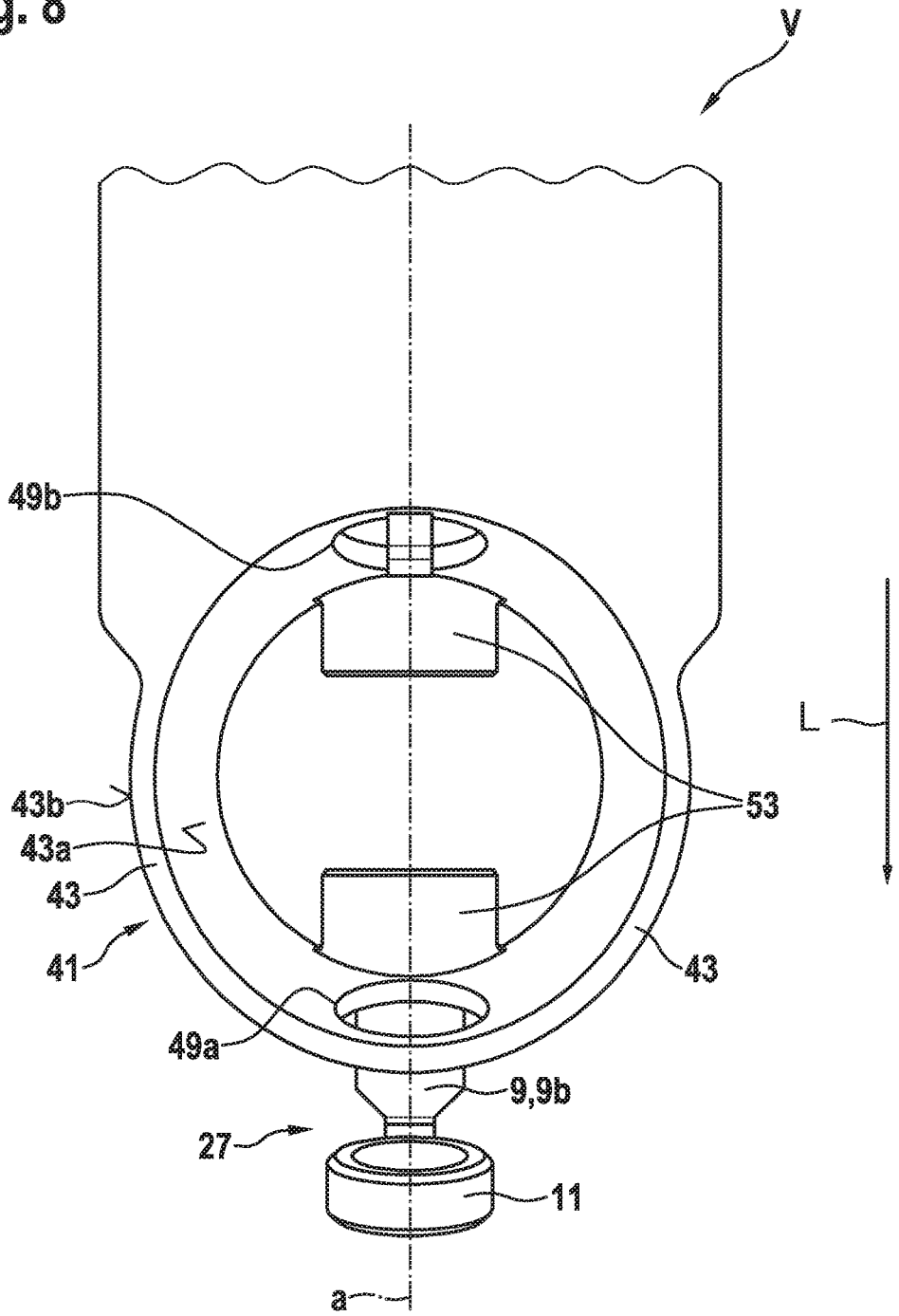

The holding means 9 of the second embodiment of the packaging unit 3 can be seen in FIG. 7 and FIG. 8. The holding means 9 is realized as a holding arm 9*b*. The holding arm 9*b* is flat, and extends in the longitudinal direction L and in the transverse direction Q. In this case, an extent at right angles to the longitudinal direction L and the transverse direction Q is substantially less than an extent in the longitudinal direction L or in the transverse direction Q.

The holding means 9 has a taper in the transverse direction Q that adjoins the connecting means 27 in the longitudinal direction L and realizes a minimum extent of the holding means 9 in the transverse direction Q. The taper in this case adjoins the connecting means 27 and, when the holding means 9 is subjected to load, deflects acting forces and stresses onto the connecting means 27. The connecting means 27 is realized as a material weakness. The connecting means 27 is realized as a notch.

Further, the viewing region 41 has two stabilizing elements 53, which are opposite each other and project into the viewing region 41. The stabilizing elements 53 are designed to compensate a weakness of the wall 43 resulting from the recesses 49*a*, 49*b* provided in the wall. The two stabilizing elements 53 are realized as stabilizing lugs. The two stabilizing elements 53 are disposed on the back side R of the packaging unit 3, and delimit the viewing region 41 in the longitudinal direction L and in the transverse direction Q. The two stabilizing lugs are each disposed adjacently to the recesses 49*a*, 49*b* of the wall 43.

Figure 9:
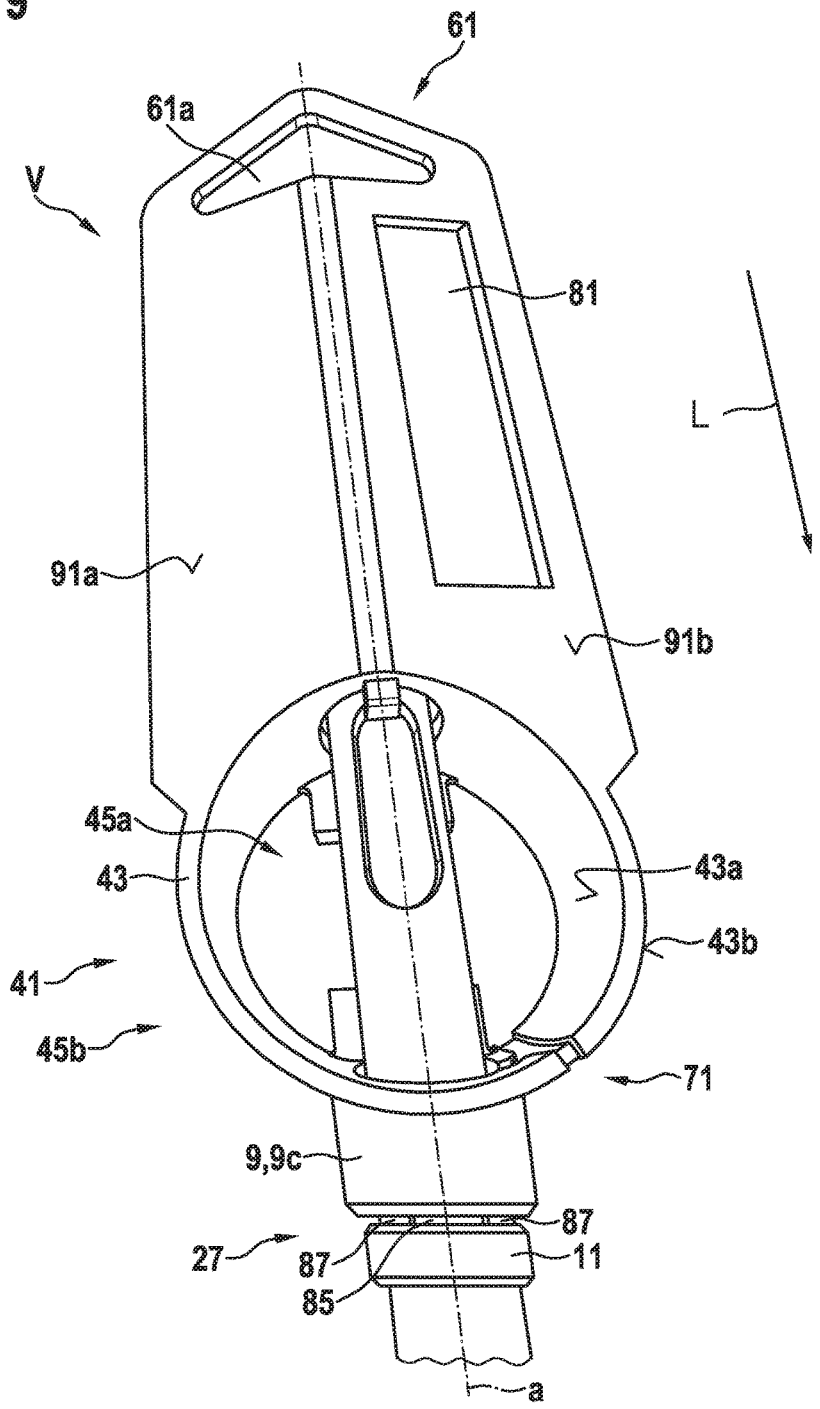
Figure 10:
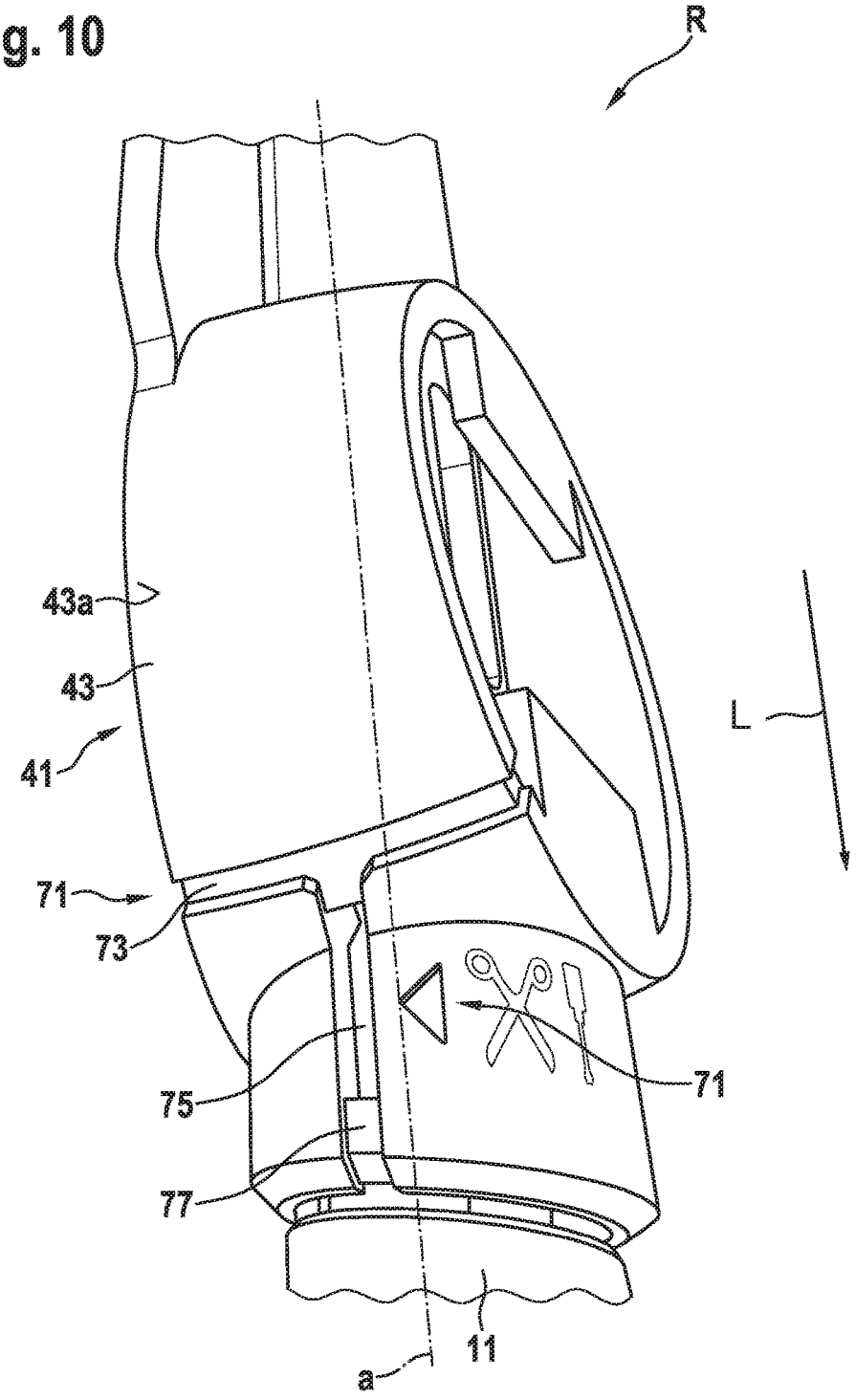

FIG. 9 and FIG. 10 show a third embodiment of the packaging unit 3 according to the disclosure as shown in FIG. 2. The holding means 9 is realized as a holding ring 9*c*, and adjoins an outer surface 43*b* of the wall 43. The holding means 9 is at least substantially in the form of a hollow cylinder. The holding means 9 encompasses the insert tool 1 in a plane around 360°. The holding means 9 is disposed concentrically in relation to the receiving means 11. The holding means 9 is connected to the receiving means 11 via the connecting means 27. The connecting means 27 has a perforation, such that, in the circumferential direction around the longitudinal axis a, the connecting means 27 has a plurality of material openings 85, which are separated from the material webs 87 connecting the holding means 9 and the receiving means 11. The material openings 85 have a maximum extent, along the circumferential direction about the longitudinal axis a, that is greater than a maximum extent of the material webs 87 along the circumferential direction.

The wall 43 of the receiving region 7 has a separating device 71 for releasing the receiving region 7 of the packaging unit 3 from the insert tool 1 and/or the receiving means 11. The separating device 71 comprises a material weakness 73 that extends substantially at right angles to the longitudinal direction L and to the transverse direction Q. The material weakness 73 may be realized as a separating notch and/or as a separating cavity. The separating notch 73 is designed to enable the wall 43 of the receiving region 7 to be separated easily, in that the user separates the wall 43 at the separating notch 73 by means of an auxiliary tool such as, for example, gripping pliers or scissors. This causes the supporting action of the wall 43 of the receiving region 7 and/or of the stabilizing element 53 upon the insert tool 1 to be reduced, or minimized, such that, for example, a tensile and/or flexural load of the fastening region 5 acts substantially upon the connecting means 27, between the holding means 9 and the receiving means 11. The insert tool 1 that is in the packaging unit 3 is also protected against theft in a particularly reliable manner, in that the separating device 71 of the receiving region 7 prevents a tensile and/or flexural load from acting substantially upon the connecting means 27, or upon the material weakness 27, and thus an all too rapid removal of the insert tool 1 from the packaging unit 3 is reliably prevented.

As can be seen in FIG. 9, for example, the separating device 71 additionally comprises a separating recess 75 extending in the longitudinal direction L of the holding means 9. The separating recess 75 is delimited in the longitudinal direction L by the separating notch 73 and a separating web 77 that is opposite the separating notch 73. The separating recess 75 is designed for producing a rotary motion that separates the separating web 77, by means of an auxiliary tool such as, for example, a screwdriver or a pair of scissors, that engages in the separating notch 73.

Unlike the second embodiment, the second identification surface 91*b* of the third embodiment has a security recess 81. The security recess 81 is not limited only to the third embodiment, however, but may also be provided on the first or second embodiment of the packaging unit 3. The security recess 81 is designed to protect a security element, not represented further, such as, for example, an RFID transponder, against theft. The security recess 81 extends along the longitudinal direction L of the packaging unit 3.

Figure 11B:
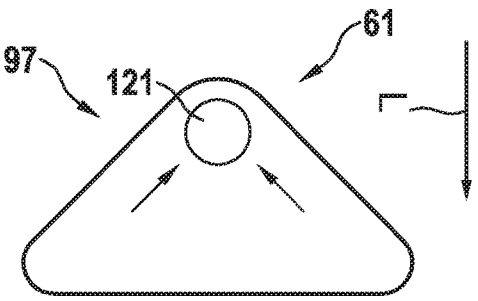
Figure 11D:
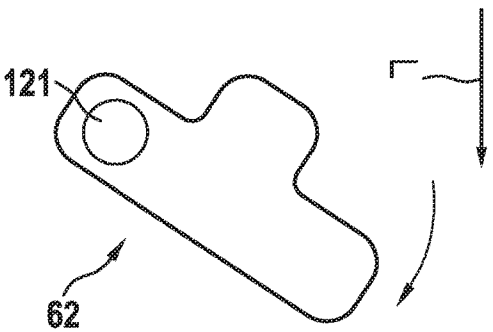
Figure 11A:
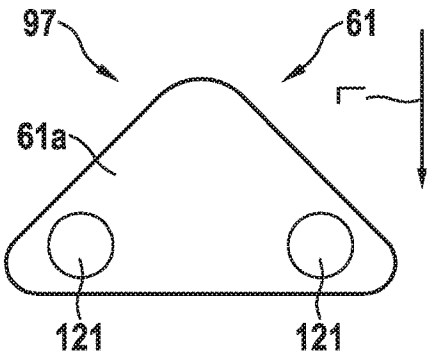
Figure 11C:
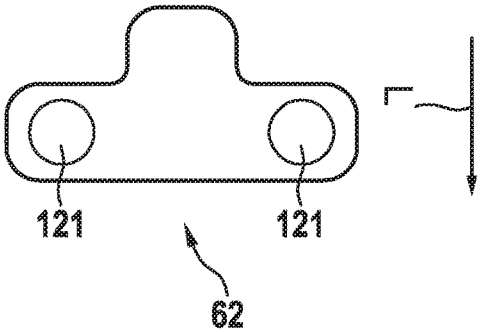

FIG. 11 shows various embodiments of the first means 61 realized as fastening means 61, FIG. 11*a* and FIG. 11*b* showing the preferred fastening means 61 in comparison with the Euro-standard hole fastening means 62, already known from the prior art, according to FIG. 11*c* and FIG. 11*d*. FIG. 11*a* and FIG. 11*c* in this case show, exemplarily, how the fastening means 61 is suspended by means of a carrier rail 121 realized as a double rail. The carrier rail 121 realized as a double rail thereby defines two support regions that fix the packaging unit 3 securely in place and orient the longitudinal axis a of the packaging unit 3 substantially parallel to a center of gravity line of the packaging unit 3, such that the packaging unit 3 and the insert tool 1 are oriented vertically in or on a presentation device such as, for example, a sales rack. In FIGS. 11*b* and 11*d*, the fastening means 61 is suspended by means of a carrier rail 121 realized as a single rail. The carrier rail 121 realized as a single rail defines only one support region, which fixes the packaging unit 3 in place. In this case, in the case of a Euro-standard hole fastening means, such as that represented in FIG. 11*d*, for example, there may be an unfavorable orientation of the packaging unit 3 in or on the presentation device, in that the longitudinal axis a of the packaging unit 3 is angled in relation to a center of gravity line of the packaging unit 3. This occurs, for example, if the single rail is resting on a support region designed for the double rail. As a result, the packaging unit 3 is oriented sideways, such that it is no longer oriented vertically along the longitudinal direction L of the packaging unit 3, but is at an angle in relation to the longitudinal direction L of the packaging unit 3. This is an undesirable effect that can arise if a packaging unit 3 having a Euro-standard hole fastening means is inadvertently suspended in an unfavorable manner. This is prevented with the preferred, substantially triangular, fastening means 61, since, even if the single rail is inadvertently positioned in an unfavorable manner on the fastening means 61, the fastening means 61 aligns itself as a result of the force of gravity acting on the packaging unit 3, such that the single rail moves, or slides, into the position of the fastening means 61 intended for the single rail.

The invention claimed is:

1. A tool system comprising:

an insert tool defining a tapered recess that encompasses the insert tool in a circumferential direction; and a packaging unit including a fastening portion configured to fasten the packaging unit in or on a presentation device, and a receiving portion configured to receive the insert tool, the receiving portion connected in a form-fitting manner to the insert tool, the receiving portion configured to hold the insert tool in a holding state of the packaging unit in which the receiving portion is integral with the fastening portion, wherein, in a separation state, in which the receiving portion is separated from the fastening portion, the receiving portion remains connected in the form-fitting manner to the insert tool, wherein the receiving portion is connected to the insert tool in the form-fitting manner at the tapered recess, and wherein the receiving portion is configured to cover, at least partially, the tapered recess.

2. The tool system according to claim 1, wherein the receiving portion remains connected in the form-fitting manner to the insert tool during operation of the insert tool.

3. The tool system according to claim 2, wherein the receiving portion dampens vibrations during the operation of the insert tool.

4. The tool system according to claim 1, wherein the packaging unit further includes a holding element configured to hold the receiving portion in the holding state in or on the packaging unit.

5. The tool system according to claim 4, wherein the packaging unit further includes a connecting structure having a material weakness and located between the holding element and the receiving portion.

6. The tool system according to claim 4, wherein the holding element is configured as a holding arm or a holding ring.

7. The tool system according to claim 4, wherein the holding element includes a separation device configured to release or to separate the insert tool and/or the receiving portion from the holding element.

8. The tool system according to claim 1, wherein the receiving portion is configured as an enclosing element that encompasses the insert tool in the form-fitting manner to prevent relative movement between the receiving portion and the insert tool.

9. The tool system according to claim 1, wherein the receiving portion is configured as a hollow cylinder.

10. A packaging unit for an insert tool comprising:

a fastening portion configured to fasten the packaging unit in or on a presentation device, the fastening portion including a circular holding ring; and a receiving portion configured to receive at least a portion of the insert tool, the receiving portion connected in a form-fitting manner to the insert tool; and a plurality of material webs extending from the holding ring to the receiving portion and configured to connect the receiving portion to the holding ring and to hold the insert tool in a holding state of the packaging unit, wherein, in a separation state, in which each material web of the plurality of material webs is broken to separate the receiving portion from the holding ring, the receiving portion remains connected in the form-fitting manner to the insert tool.

11. The packaging unit according to claim 10, wherein a material opening of a plurality of material openings is located between corresponding pairs of material webs of the plurality of material webs.

12. The packaging unit according to claim 10, wherein:

the receiving portion is a receiving ring defining a receiving longitudinal axis, the insert tool defines a tool longitudinal axis, and the receiving longitudinal axis and the tool longitudinal axis are coaxial.

13. The packaging unit according to claim 12, wherein:

the holding ring defines a ring longitudinal axis, and the ring longitudinal axis and the receiving longitudinal axis are coaxial when the plurality of material webs is unbroken.

14. The packaging unit according to claim 10, wherein the receiving portion is configured as an enclosing element that encompasses the insert tool in the form-fitting manner to prevent relative movement between the receiving portion and the insert tool.

15. The packaging unit according to claim 10, wherein the receiving portion is configured as a hollow cylinder.

16. The packaging unit according to claim 10, wherein the fastening portion has a material opening and is configured to suspend the packaging unit in or on the presentation device.

* * * * *